US010835038B2

(12) United States Patent
Johannesson

(10) Patent No.: US 10,835,038 B2
(45) Date of Patent: Nov. 17, 2020

(54) ARRANGEMENT FOR TIPPING OVER PREVENTION OF A FURNITURE AND A FURNITURE COMPRISING SUCH ARRANGEMENT

(71) Applicant: IKEA SUPPLY AG, Pratteln (CH)

(72) Inventor: Adam Johannesson, Braås (SE)

(73) Assignee: IKEA Supply AG, Pratteln (CH)

( * ) Notice: Subject to any disclaimer, the term of this patent is extended or adjusted under 35 U.S.C. 154(b) by 0 days.

(21) Appl. No.: 16/465,464

(22) PCT Filed: Nov. 28, 2017

(86) PCT No.: PCT/SE2017/051180
§ 371 (c)(1),
(2) Date: May 30, 2019

(87) PCT Pub. No.: WO2018/106167
PCT Pub. Date: Jun. 14, 2018

(65) Prior Publication Data

US 2019/0365098 A1 Dec. 5, 2019

(30) Foreign Application Priority Data

Dec. 5, 2016 (SE) ..... 1651592-6

(51) Int. Cl.
*A47B 88/00* (2017.01)
*A47B 88/427* (2017.01)
(Continued)

(52) U.S. Cl.
CPC ..... *A47B 88/427* (2017.01); *A47B 97/00* (2013.01); *A47B 88/57* (2017.01);
(Continued)

(58) Field of Classification Search
CPC ..... E05B 65/463; E05B 64/464; A47B 97/00; A47B 2097/008
See application file for complete search history.

(56) References Cited

U.S. PATENT DOCUMENTS 3,622,216 A * 11/1971 Haunost ..... E05B 65/463 312/219
4,480,883 A * 11/1984 Young ..... E05B 65/464 312/216

(Continued)

OTHER PUBLICATIONS

International Search Report and Written Opinion for PCT/SE2017/051180, dated Feb. 22, 2018.

*Primary Examiner* — Matthew W Ing
(74) *Attorney, Agent, or Firm* — Merchant & Gould P.C.

(57) ABSTRACT

An arrangement for tipping over prevention of a furniture (1) such as a chest of drawers or a cabinet comprising at least one drawer. The arrangement comprises a bar (300) and an attachment adapted to anchor the furniture (1) to a wall (W). The attachment comprises a guiding bracket (100) and an anchoring bracket (200) adapted to be movable between a first position and a second position in view of the guiding bracket (100). The anchoring bracket (200) has an anchoring portion (206) adapted to anchor the furniture (1) to a wall (W). The bar (300) is movable between a restriction position and a clearance position when acted upon by the anchoring bracket (200). When the anchoring bracket (200) is moved from the first position to the second position a wedge shaped support member (204) forces a projection (302) of the bar (300) to move along the wedge shaped support member (204) thereby moving the bar (300) from the restriction position to the clearance position, in which clearance position the drawer (4) is allowed to be pushed or pulled past a stop member (301) of the bar (300).

12 Claims, 9 Drawing Sheets

(51) Int. Cl.
*A47B 97/00* (2006.01)
*A47B 88/57* (2017.01)
*E05B 65/463* (2017.01)

(52) U.S. Cl.
CPC . *A47B 2088/4276* (2017.01); *A47B 2097/008* (2013.01); *E05B 65/463* (2013.01)

(56) References Cited

U.S. PATENT DOCUMENTS

| | | | | | |
|---|---|---|---|---|---|
| 4,863,132 | A * | 9/1989 | Fitzgerald | A47B 97/00 | 248/274.1 |
| 5,056,877 | A * | 10/1991 | Westwinkel | E05B 65/464 | 312/217 |
| 5,074,627 | A * | 12/1991 | Broeders | E05B 65/464 | 312/218 |
| 5,671,985 | A * | 9/1997 | Grieser | E05B 65/463 | 312/217 |
| 5,702,167 | A * | 12/1997 | Muller | E05B 65/464 | 312/217 |
| 5,839,803 | A * | 11/1998 | Lizell | E05B 65/463 | 312/107.5 |
| 6,220,562 | B1 * | 4/2001 | Konkle | A47B 97/00 | 24/298 |
| 6,896,342 | B1 * | 5/2005 | Cheng | E05B 65/463 | 312/217 |
| 10,273,721 | B1 * | 4/2019 | Chen | E05B 65/462 | |
| 2003/0076016 | A1 | 4/2003 | Westwinkel | | |
| 2006/0097123 | A1 * | 5/2006 | Gallien | A47B 97/00 | 248/500 |
| 2018/0042379 | A1 * | 2/2018 | Muskopf | A47B 95/00 | |

* cited by examiner

ARRANGEMENT FOR TIPPING OVER PREVENTION OF A FURNITURE AND A FURNITURE COMPRISING SUCH ARRANGEMENT

This application is a National Stage Application of PCT/SE2017/051180, filed 28 Nov. 2017, which claims the benefit of priority to Swedish Patent Application No. 1651592-6, filed 5 Dec. 2016, which applications are incorporated herein by reference. To the extent appropriate, a claim of priority is made to each of the above disclosed applications.

TECHNICAL FIELD

The present invention refers to an arrangement for tipping over prevention of a furniture, such as a chest of drawers or a cabinet comprising at least one drawer. The invention also refers to a furniture comprising such arrangement.

TECHNICAL BACKGROUND

A furniture, such as a chest of drawers or a cabinet comprising at least one drawer, is a classical piece of furniture to store items in homes. The width and depth respectively of the furniture is typically substantially smaller than the height. Thereby a large storing capacity is provided for while only requiring a limited foot print.

Each drawer defines a storing volume and as a drawer is opened, the center of mass will be displaced. This is in most cases never a problem since the underlying working principle of such furniture is to pull out drawers to get access to the contents. It is however never possible to foresee how a piece of furniture is used in practice and in the worst case scenario the furniture may tip over and cause severe personal injuries. Typical risks are when the drawers at a higher level are filled with a heavy load and opened, or when a person is leaning over or seeks support against the furniture or a pulled out drawer. The latter may especially be the case when children are using the furniture, either when trying to get access to its contents by climbing or simply playing around.

As a safety measure it is well known to use brackets of different types to anchor the furniture against a wall to thereby safeguard against any tipping over. The brackets may by way of example be L-shaped brackets. Other types of brackets or strap solutions are known from U.S. Pat. No. 6,220,562 and US2006/0097123. However, even though the furniture is delivered with brackets and the manual explicitly prescribes that the brackets should be mounted before taking the furniture into use, the user from time to time decides not to mount the brackets. Common excuses are lack of time, complexity of the brackets, laciness and unawareness of risks involved in the event a tipping over should occur. Other reasons might be that the brackets are visible from the exterior of the furniture.

There is accordingly a need to find a solution to this problem and to guarantee a safe installation of a furniture and especially when the furniture is a chest of drawers or a cabinet comprising at least one drawer.

SUMMARY

An object of the present invention is to provide an arrangement for tipping over prevention of a furniture, such as a chest of drawers or a cabinet comprising at least one drawer, that at least partly overcome the above mentioned drawbacks and risks. Further, the arrangement should have a design that makes it mandatory for the user to anchor the furniture to a wall in order to be able to use the furniture properly.

The present invention relates to an arrangement for tipping over prevention of a furniture, such as a chest of drawers or a cabinet comprising at least one drawer, the arrangement comprising a bar and an attachment adapted to anchor the furniture to a wall, wherein the attachment comprises a guiding bracket adapted to be fixedly mounted to a side wall or a rear wall of the furniture, the guiding bracket having a guiding means extending in parallel with the extension of the side wall, and an anchoring bracket adapted to be movable between a first position and a second position in view of the guiding bracket while being guided by the guiding means, said anchoring bracket having an anchoring portion adapted to anchor the furniture to the wall by a fixing means when the anchoring bracket is arranged in the second position, and a wedge shaped support member, and wherein the bar is adapted to be mounted to the side wall of the furniture, and being movable between a restriction position and a clearance position, said bar having a projection being arranged to abut the wedge shaped support member of the anchoring bracket, and a stop member adapted to interact with a projection of a drawer of the furniture, whereby when the anchoring bracket is moved from the first position to the second position the wedge shaped support member forces the projection to move along the wedge shaped support member thereby moving the bar from the restriction position to the clearance position, in which clearance position the drawer is allowed to be pushed or pulled past the stop member.

Accordingly, all parts of the arrangement are arranged to be mounted on the inner walls of the furniture where they are clearly invisible from the exterior. Also, the arrangement for tipping over prevention has a design that makes it mandatory to actually anchor the furniture to the wall in order to be freely able to open and close the drawers and thereby fully use the furniture. The arrangement is very easy to install since the only measure required for anchoring the furniture to a wall is to mount a fixing means such as a screw or a bolt by a linear movement.

The guiding bracket may comprise a longitudinal groove adapted to movably receive a tongue of the anchoring bracket, whereby the movement of the anchoring bracket in view of the guiding bracket between the first and the second positions is restricted by the tongue abutting either of the two end portions of the longitudinal groove. By the interaction between the groove and the tongue, a well-controlled linear movement between the guiding bracket and the anchoring bracket will be ensured.

The guiding means of the guiding bracket may comprise first and second flanges facing each other and adapted to encircle a respective longitudinal edge portion of the anchoring bracket. This contributes to the provision of a well-controlled linear movement between the guiding bracket and the anchoring bracket. Also, the two brackets may be handled as one unit during mounting thereof to the furniture.

The anchoring bracket may comprise a base plate and the projection of the bar may be arranged to abut a wall of the wedge shaped support member extending orthogonally to the base plate.

The anchoring bracket may comprise a base plate, and the wedge shaped support member may be arranged to extend along a first side of the base plate and the anchoring portion may be arranged to project in the orthogonal direction from a second side of the base plate. Accordingly, the wedge shaped support member and the anchoring portion are arranged on opposite sides of the base plate. Thereby the fixing means will not interfere with the bar and its projection.

The guiding bracket may comprise a base plate adapted to abut the side wall of the furniture, wherein said base plate as seen in its thickness direction comprises a recess adapted to receive the wedge shaped support member of the anchoring bracket. Thereby the base plate and the wedge shaped support member may be arranged in flush with each other along the surface of the base plate that is intended to be mounted to the side wall of the furniture.

The bar may be movably received in a groove arranged in the side wall of the furniture. By the bar being received in a groove, guiding and support rails used for the drawers may be arranged across the bar and the groove while firmly abutting the inner side wall of the furniture.

The bar may further comprise a grip member. Such grip member may form part of a deadlock function in order to release the drawers and to be able to open the drawers in case the drawers have been mounted and closed before anchoring the furniture to a wall. Such grip member also allows the furniture to be handled during e.g. a relocation without the risk of the drawers accidentally being pulled out. Access to the grip member may be provided for via an access opening in the rear wall of the furniture.

The stop member of the bar may comprise a sliding surface adapted to interact with the projection of the drawer to thereby temporarily set the bar to its clearance position as the drawer is pushed past the stop member. Thereby the drawers may be fully inserted even though the furniture has not been anchored to a wall.

According to another aspect, a furniture is provided comprising an arrangement for tipping over prevention according to any of the features discussed above. To avoid undue repetition reference is given to the sections given above discussing the arrangement.

The furniture may further comprise a rear wall comprising an access opening allowing access to the grip member.

Each drawer of the furniture may be supported by guiding and support rails which are arranged in the opposing side walls of the furniture, wherein at least one of said guiding and support rails may be arranged on top of and across the groove receiving said bar.

Further objects and advantages of the present invention will be obvious to a person skilled in the art reading the detailed description given below describing different embodiments.

BRIEF DESCRIPTION OF THE DRAWINGS

The invention will be described in detail with reference to the schematic drawings.

DETAILED DESCRIPTION

Figure 1A:
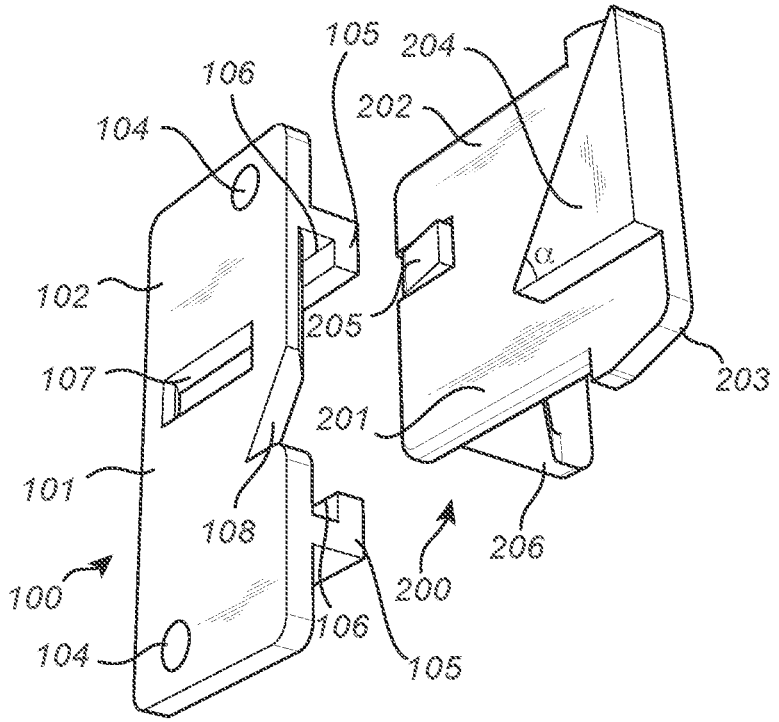
FIGS. 1*a* and 1*b* disclose perspective views of the guiding bracket and the anchoring bracket respectively.
Figure 1B:
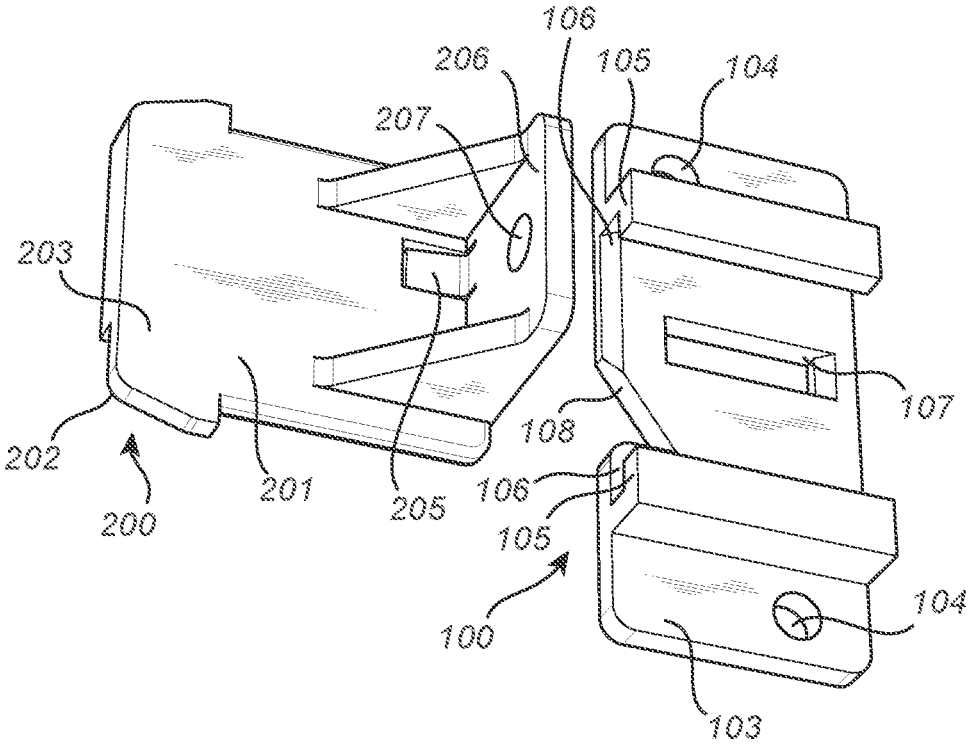

In the following the invention will be described as applied to a chest of drawers. It is however to be understood that the invention is equally applicable to other types of furniture provided with at least one drawer, such as a cabinet or the like. Starting with FIGS. 1*a* and 1*b* perspective views of the guiding bracket 100 and the anchoring bracket 200 forming parts of the arrangement are disclosed.

The guiding bracket 100 comprises a base plate 101 having a first side 102 and a second side 103. The first side 102 is adapted to be mounted to a side wall 2 of a chest of drawers 1. The base plate 101 is provided with two through holes 104 to allow the guiding bracket 100 to be mounted to a side wall 2 of the chest of drawers 1 by screwing, bolting or the like. The second side 103 is provided with two flanges 105 facing each other. Each flange 105 delimits together with the base plate 101 a longitudinal groove 106. The grooves 106 are adapted to allow the edge portions of the anchoring bracket 200 to be inserted into the grooves 106 and to be guided thereby.

The base plate 101 comprises a central longitudinal groove 107 which extends in parallel with the two grooves 106 delimited by the flanges 105. The central longitudinal groove 107 is adapted to receive a tongue 205 formed in the anchoring bracket 200.

The base plate 101 comprises as seen in its thickness direction a recess 108 in the form of a cut-out arranged along an edge portion of the base plate 101. The recess 108 has a profile corresponding to the wedge shaped support member 204 of the anchoring bracket 200 to be described below. In the disclosed embodiment the recess 108 has a triangular profile.

The guiding bracket 100 may be provided e.g. by injection molding.

The anchoring bracket 200 comprises a base plate 201 having a first side 202 and a second side 203. The first side 202 is adapted to face a side wall 2 of the chest of drawers 1 and to face and abut the second side 103 of the base plate 101 of the guiding bracket 100.

The first side 202 comprises a wedge shaped support member 204. The wedge shaped support member 204 has a profile corresponding to the recess 108 in the base plate 101 of the guiding bracket 100. The wedge shaped support member 204 has a triangular profile having an extension in the plane of the base plate 201. In the disclosed embodiment the triangular profile has an angle $\alpha$ of 45°. It is however to be understood that other angles or profiles, such as an arc shape may be used. The wedge shaped support member 204 has a thickness that preferably corresponds to the thickness of the base plate 101 of the guiding bracket 100.

The first side 202 further comprises a tongue 205 adapted to engage the central longitudinal groove 107 in the base plate 101 of the guiding bracket 100.

The second side 203 of the base plate 201 comprises an anchoring portion 206 that projects in the orthogonal direction from the base plate 201. The anchoring portion 206 comprises a through hole 207 adapted to receive a fixing means 208 such as a screw or bolt. When mounted to the chest of drawers 1, the anchoring portion 206 is arranged to abut the rear wall 3 of the chest of drawers 1. The fixing means 208 will hence extend from the anchoring portion 206, through the rear wall 3 before engaging a wall W.

The anchoring bracket 200 may be provided e.g. by injection molding.

Figure 2:
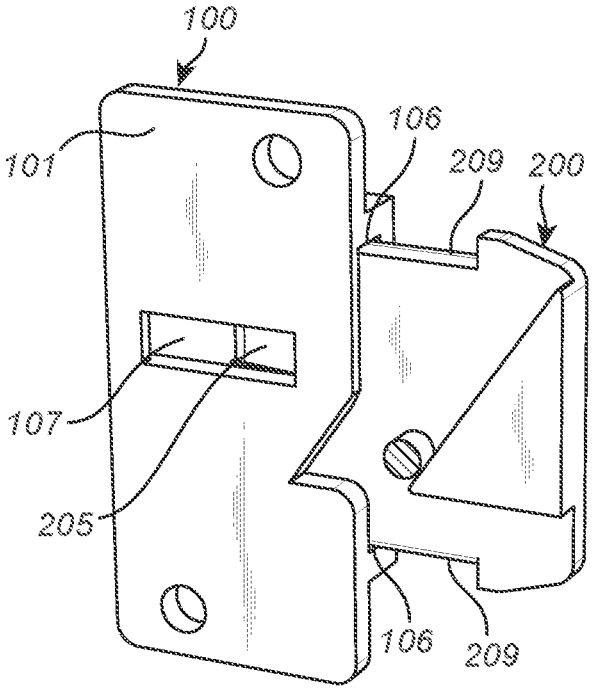
FIG. 2 discloses the anchoring bracket as mounted to the guiding bracket.

As seen in FIG. 2, the anchoring bracket 200 is adapted to slidingly engage the guiding bracket 100. This is made by the opposing side edges 209 of the anchoring bracket 200 being received in the grooves 106 of the guiding bracket 100 and also by the tongue 205 of the anchoring bracket 200 being received in the central longitudinal groove 107 in the base plate 101 of the guiding bracket 100. Thereby the anchoring bracket 200 may be moved back and forth in view of the guiding bracket 100 between a first and a second position. The first and the second positions are determined by the tongue 205 of the anchoring bracket 200 engaging the opposing ends of the central longitudinal groove 107 of the guiding bracket 100.

Figure 3:
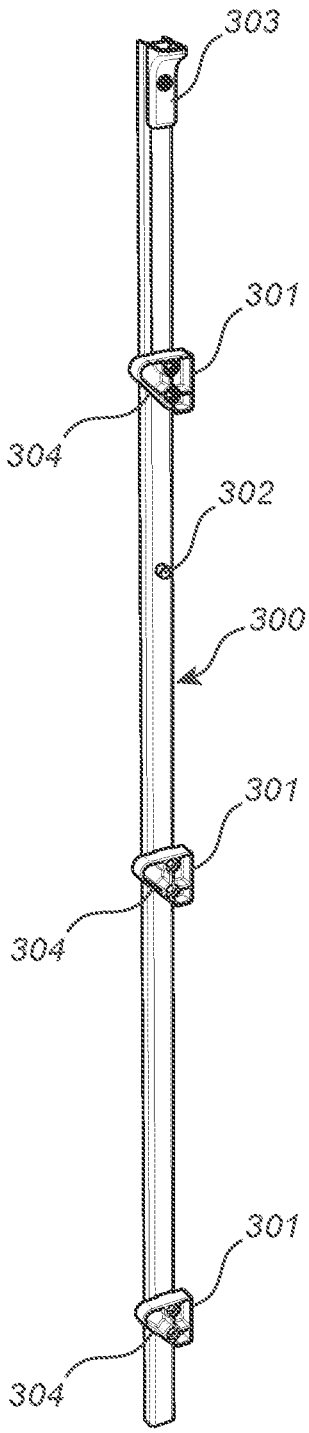
FIG. 3 discloses the bar.

Now turning to FIG. 3, one embodiment of a bar 300 forming part of the arrangement is disclosed. The bar 300 is disclosed as having a longitudinal extension and a U-shaped cross section. It is to be understood that other cross sections are equally applicable. The bar 300 comprises three stop members 301 which are distributed along the longitudinal extension of the bar 300. The bar 300 should have at least one stop member 301 in order to be able to interfere with the closing of at least one drawer 4 in a chest of drawers 1. The number of stop members 301 may correspond to the number of drawers 4.

Each stop member 301 has a wedge shaped profile with a downwardly facing sliding surface 304, as will be described below. The sliding surface 304 is adapted to interact with projections 7 on the drawers 4.

The bar 300 comprises a projection 302 adapted to face and engage the wedge shaped support member 204 of the anchoring bracket 200, as will be descried in detail below.

The bar 300 comprises a grip member 303 forming part of a deadlock feature. In the disclosed embodiment the grip member 303 is arranged in the upper end of the bar 300. The grip member 303 will be further described below with reference to FIGS. 8*a* and 8*b*.

Figure 4:
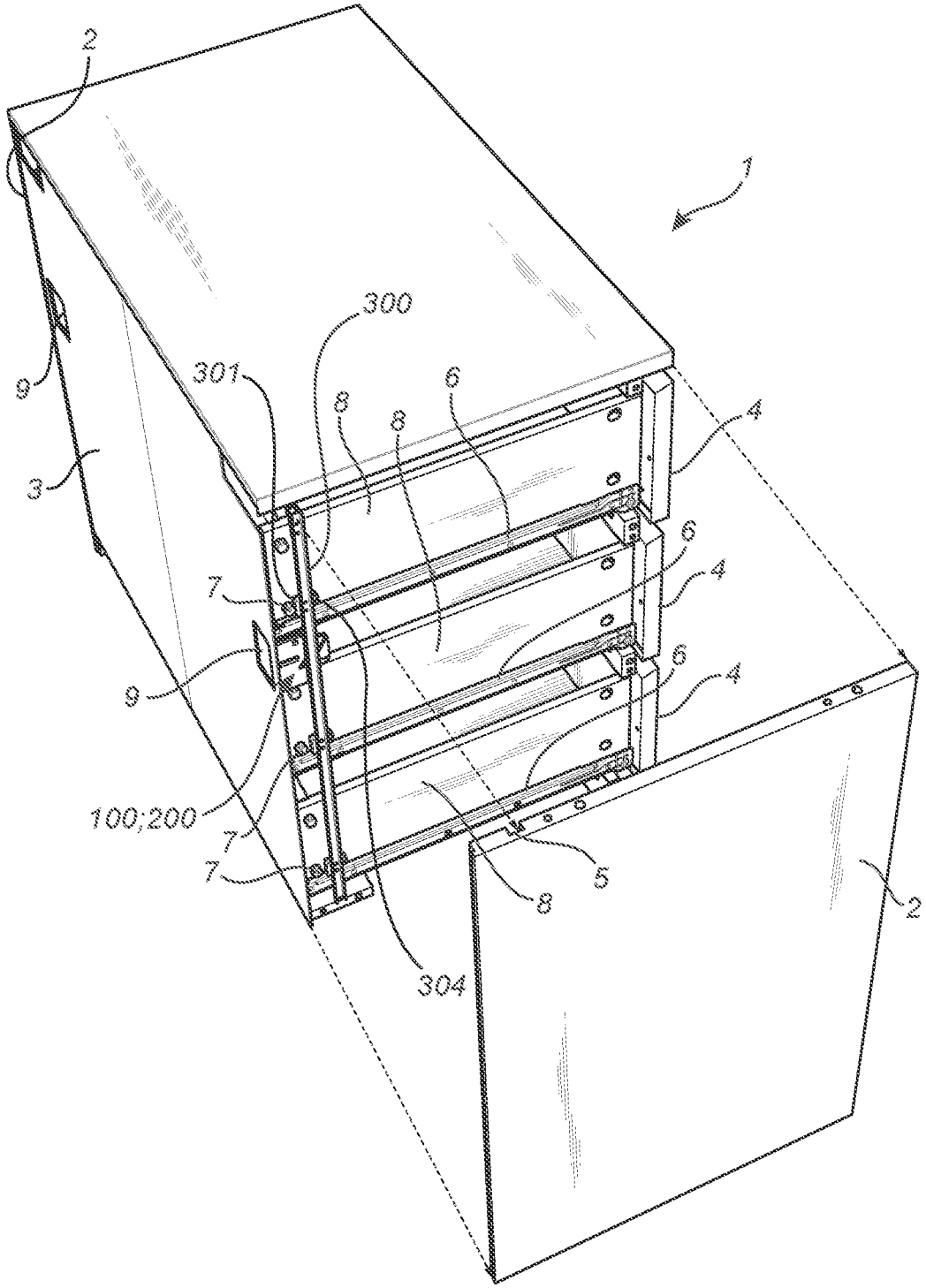
FIG. 4 discloses a partial exploded view of a chest of drawers with an arrangement for tipping over prevention.

Turning to FIG. 4 a chest of drawers 1 is disclosed with an arrangement for tipping over prevention. The chest of drawers 1 comprises three drawers 4, opposing side walls 2 and a rear wall 3. The chest of drawers 1 is disclosed in a stand-alone position without having been anchored to a wall. Also, the drawers 4 have been fully inserted.

The side wall 2 comprises along its inner surface a longitudinal groove 5 adapted to slidably receive the bar 300. When the bar 300 is received in the groove 5, the three stop members 301 are arranged to abut the inner side wall 2. Also, the projection 302 (not shown in FIG. 4) arranged on the bar 300 is facing away from the groove 5. Further, the sliding surfaces 304 of the stop members are facing downwardly and away from the rear wall 3.

The guiding bracket 100 is mounted to the side wall 2 of the chest of drawers 1. The anchoring bracket 200 is slidably inserted into the guiding bracket 100. The guiding bracket 100 is arranged in a position so that the projection 302 of the bar 300 is received in contact with the wedge shaped support member 204 of the anchoring bracket 200.

Each drawer 4 is in a well-known manner supported by guiding and support rails 6 mounted to and extending along the inner surface of the side wall 2. The guiding rails 6 are arranged across the bar 300. Thereby the bar 300 will be prevented from falling out of the groove 5. It is to be understood that the bar 300 may be retained in the groove 5 by other means.

Each drawer 4 comprises a projection 7 arranged at the rear end of its respective side wall 8. Each projection 7 faces the side wall 2 of the chest of drawers 1. The stop members 301 are distributed along the longitudinal extension of the bar 300 so that the projections 7 on the drawers 4 are arranged in level and aligned with the respective stop members 301 of the bar 300. When the drawers 4 are pushed and thereby inserted into the chest of drawers 1 in the horizontal direction, the projections 7 will act against the respective sliding surfaces 304 of the stop members 301, thereby temporarily moving the bar 300 upwards inside the groove 5 into what is known as a clearance position. This can be seen as being the result of a wedge action. As the insertion of the drawers 4 continues, the projections 7 will horizontally pass the bar 300 and after having fully passed, the bar 300 will fall back into what is known as a restriction position due to gravity.

When the drawers 4 have been fully inserted into the chest of drawers 1, each projection 7 is arranged in a position between the rear wall 3 of the chest of drawers 1 and the bar 300. Since the sliding surfaces 304 of the stop members 301 are facing downwardly away from the rear wall 3, the drawers 4 are in this position prevented from being pulled out.

The rear wall 3 preferably comprises cut-outs 9 in the area of the intended position of the guiding brackets 100 and the anchoring bracket 200, see FIG. 4. Thereby there is no need for the person who will anchor the furniture to a wall to also provide a hole in the rear wall 3 of the furniture in order to receive the fixing member 208, such as a screw or bolt, which is used when anchoring the furniture to the wall.

Now referring to FIGS. 5*a*-5*c* and 6*a*-6*c*, the operation of the arrangement for tipping over prevention of a chest of drawers 1 will be described.

Figure 5B:
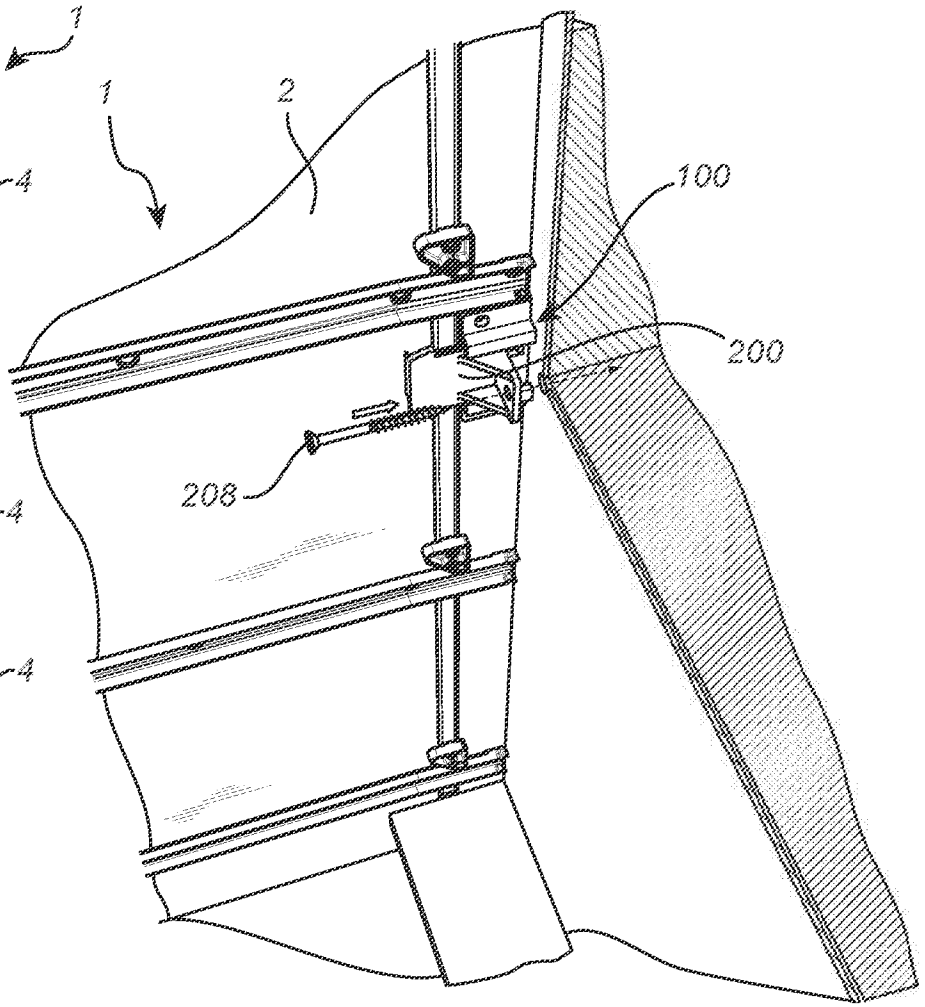
FIGS. 5*a*-5*c* discloses the arrangement in a position before anchoring of the chest of drawers to a wall.
Figure 5A:
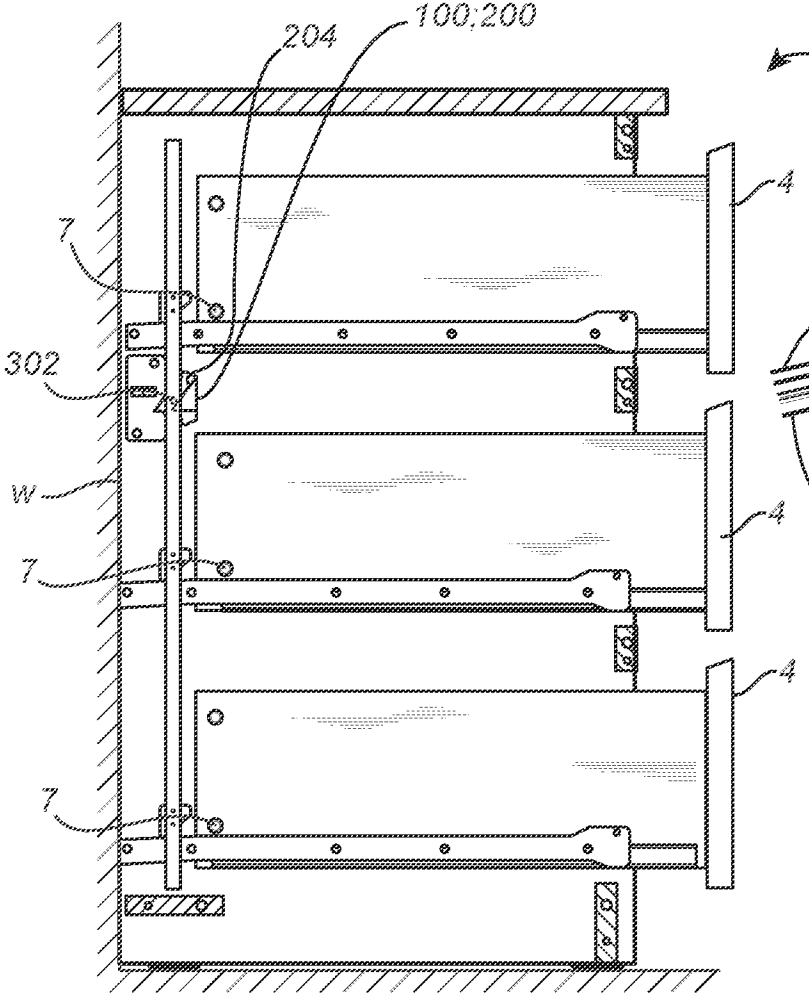
Figure 5C:
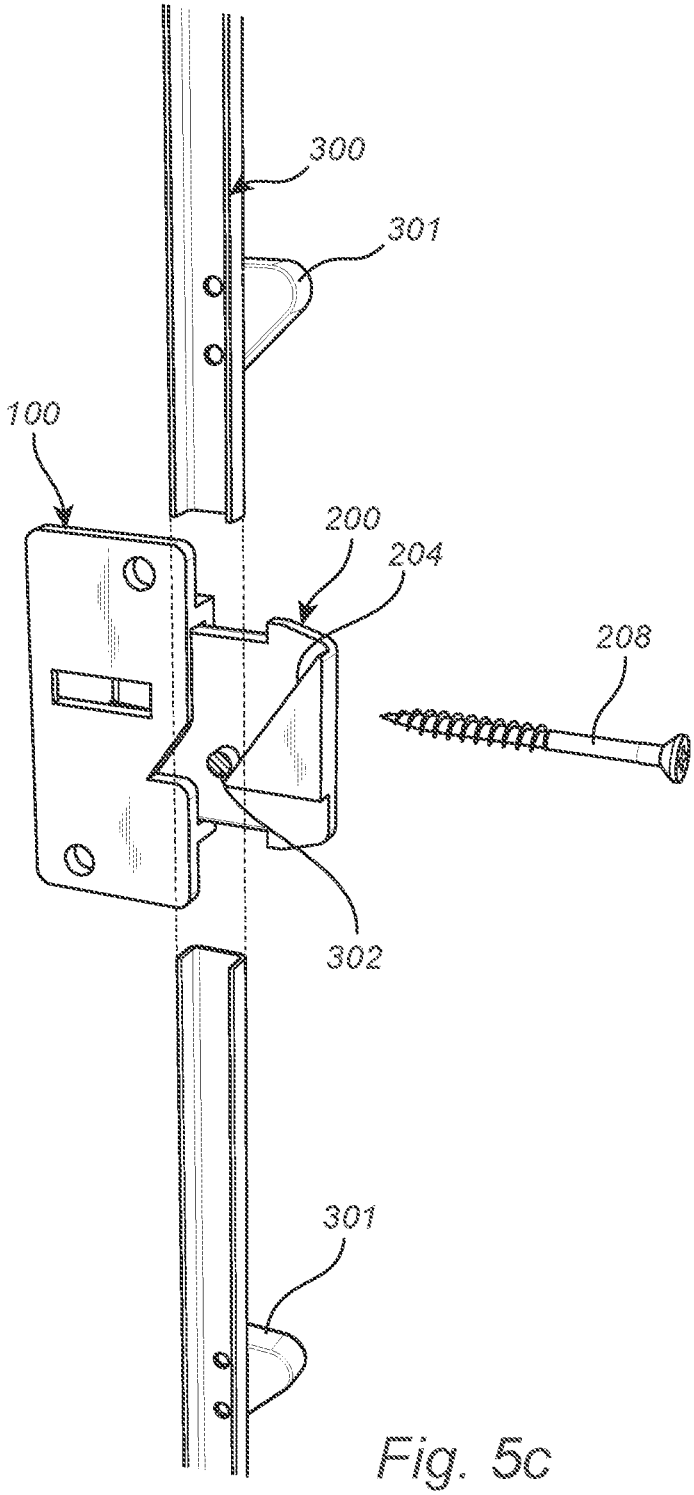

Starting with FIGS. 5*a*-5*c* the arrangement is disclosed before anchoring the chest of drawers 1 to a wall W and also before the drawers 4 have been fully inserted. In fact, to get access to the anchoring bracket 200 and the guiding bracket 100 the drawers 4 should be completely removed.

As is best seen in FIGS. 5*b* and 5*c*, the anchoring bracket 200 is set to its first position in view of the guiding bracket 100. The bar 300 is set to the restriction position. In this position, the projection 302 of the bar 300 is resting on a lower end of the wedge shaped support member 204. The drawers 4 are in this position prevented from being fully inserted in the chest of drawers 1 by the stop members 301 of the bar 300 being horizontally aligned with the respective projections 7 of the drawers 4.

Figure 6B:
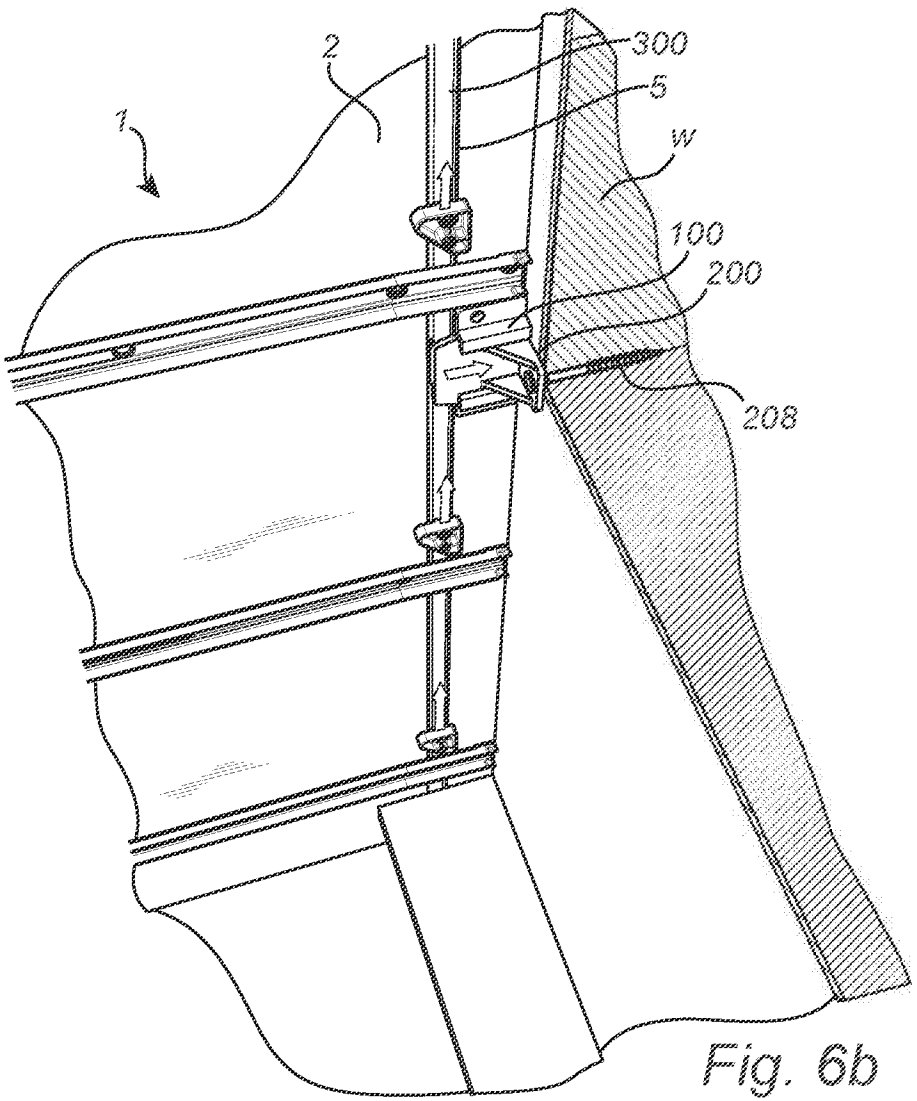
FIGS. 6*a*-6*c* discloses the arrangement in a position when the chest of drawers has been anchored to a wall.
Figure 6A:
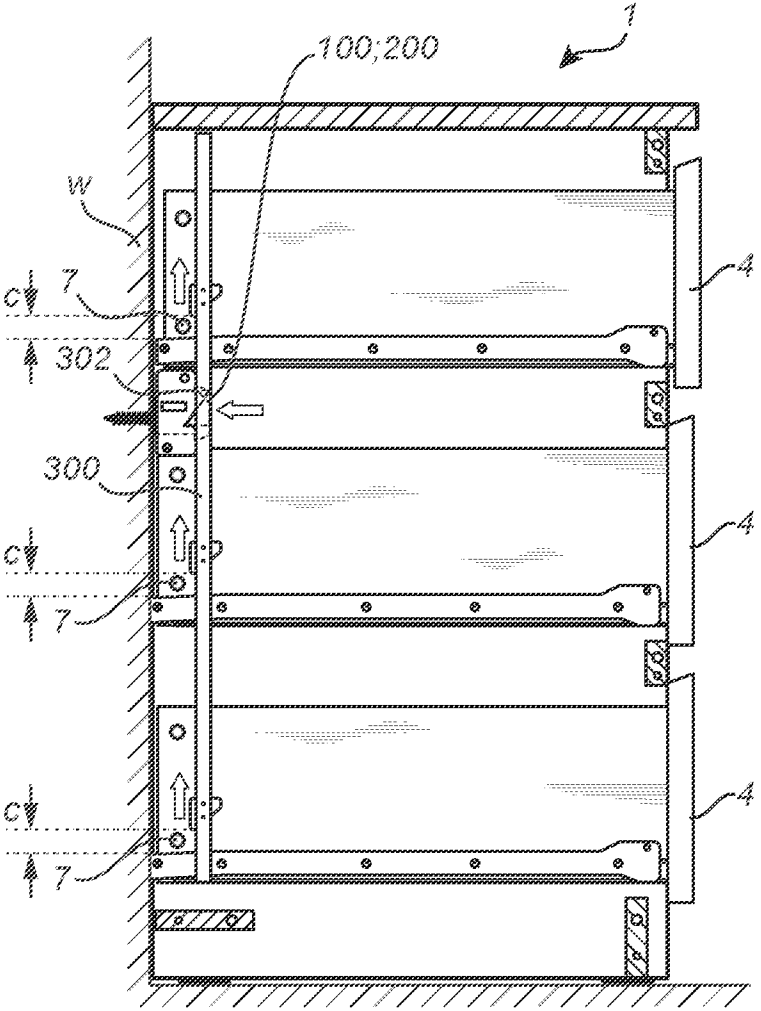
Figure 6C:
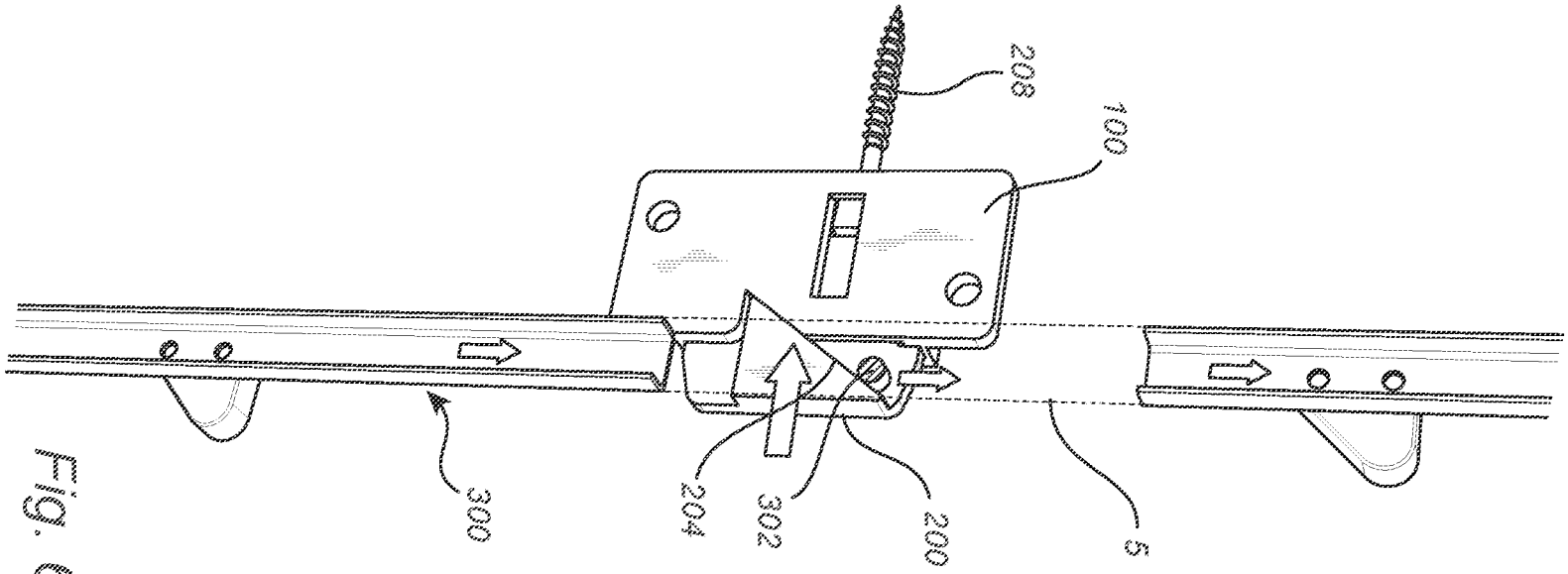

Now turning to FIGS. 6*a*-6*c*, the chest of drawers 1 is anchored to the wall W by means of a fixing means 208 such as a screw or bolt. As the fixing means 208 engages the wall W, the anchoring bracket 200 is moved inside the guiding bracket 100 from the first position to the second position, see FIGS. 6*b*-6*c*. During this movement the wedge shaped support member 204 forces the bar 300 to slide upwards in the vertical direction inside the groove 5 in the side wall 2 of the chest of drawers 1 into the clearance position. The bar 300 together with the stop members 301 is forced to move by the projection 302 of the bar 300 sliding against the wedge shaped support surface 204. As a result of this movement of the bar 300, a vertical clearance C is formed allowing the drawers 4 to be freely pulled out.

Figure 7:
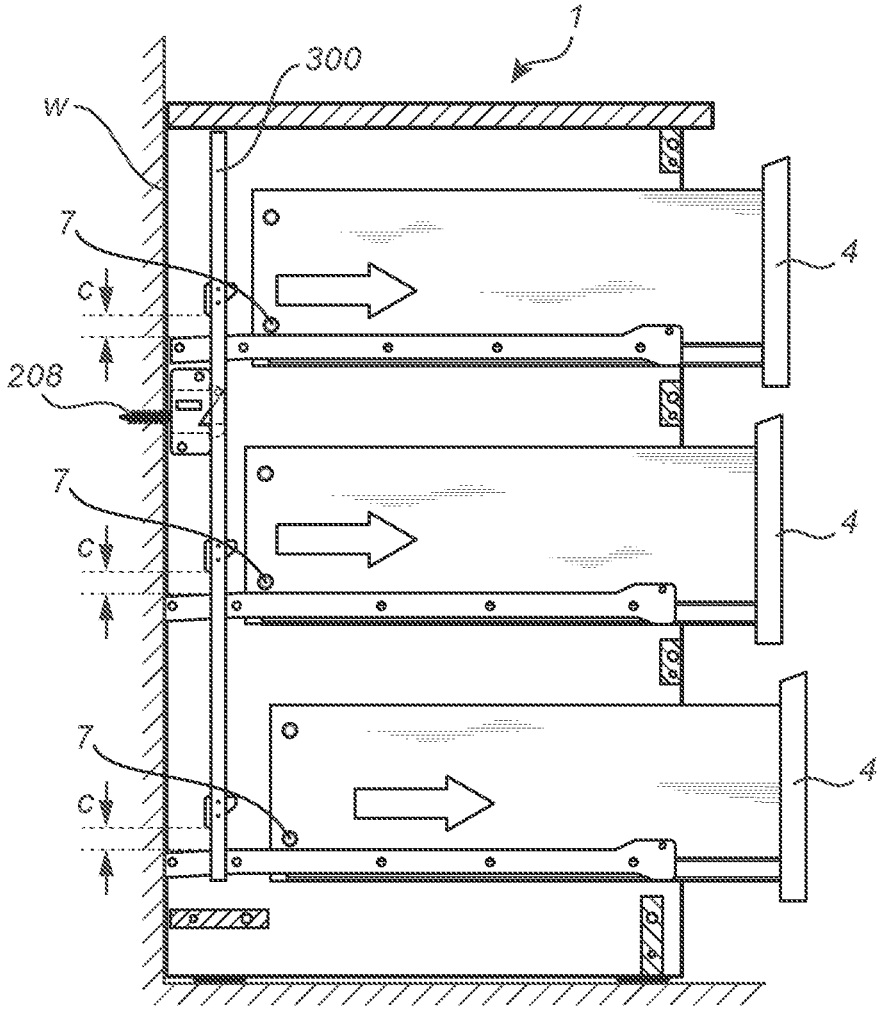
FIG. 7 illustrates schematically the clearance provided when the chest of drawers has been anchored to a wall.

The bar 300 is remained in the clearance position as long as the chest of drawers 1 is anchored to the wall W by the fixing means 208, see FIG. 7.

Figures 8A, 8B:
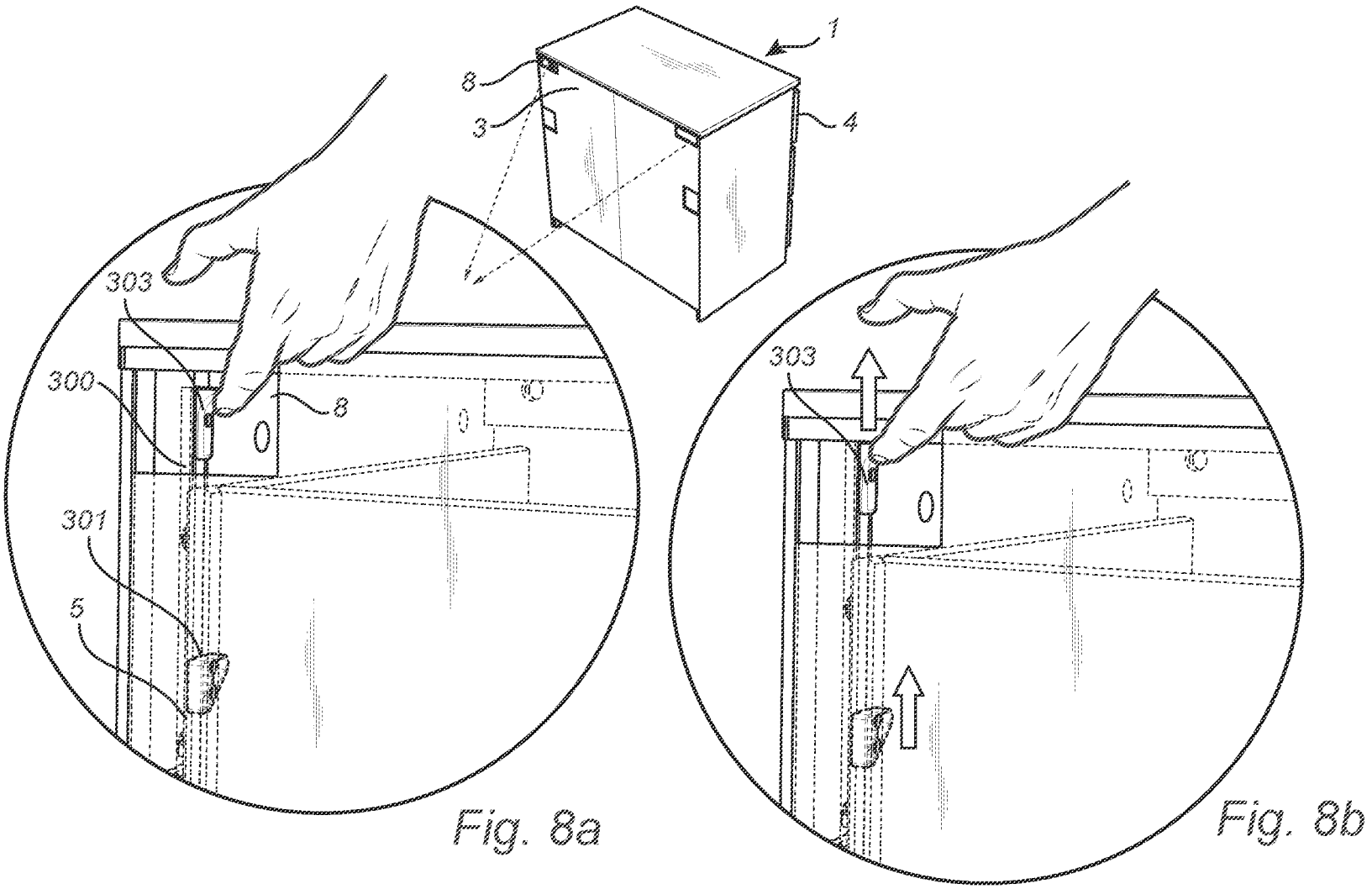
FIGS. 8*a* and 8*b* discloses the operation of a deadlock function.

Turning to FIGS. 8*a*, 8*b* and 6*a*, the grip member 303 and the deadlock feature will be described. In the disclosed embodiment the grip member 303 is arranged in the upper end of the bar 300. Access to the grip member 303 is provided for via an access opening 8 in the rear wall 3 of the chest of drawers 1. The deadlock feature may by way of example be useful when a chest of drawers 1 is provided to be used as a pre-assembled piece of furniture or during a relocation. The deadlock feature allows the chest of drawers 1 to be moved around without the risk of the drawers 4 accidentally being pulled out. Also, the grip member 303 allows opening and removal of the drawers 4 in case they should have been inserted to the chest of drawers 1 before anchoring the same to a wall.

In order to operate the deadlock feature, the user inserts his/her fingers through the access opening 8, grips the grip member 303 and pulls it in the upward vertical direction. The bar 300 will thereby be moved from the restriction position to the clearance position. The bar 300, together with the stop members 301 will thus by displaced along the groove 5. Thereby a clearance C is provided that allows the drawers 4 with their projections 7 to pass the bar 300 and thereby the drawers 4 to be pulled out. When completely removing the drawers 4 from the chest of drawers 1, access is provided to the arrangement for tipping over prevention, thereby allowing the chest of drawers 1 to be anchored to the wall W.

If on the other hand the grip member 303 should be released, the bar 300 will return to its restriction position by gravity and hence close the clearance C. The drawers 4 will thereby anew be prevented from being pulled out.

The arrangement has been described with the bar 300 to be moved in the upwards direction when anchoring the chest of drawers 1 to a wall W and thereby setting the same to the clearance position. It is to be understood that the same principle is applicable by instead arranging the bar 300 to be operated in the downward direction.

The skilled person will understand that the type of fixing means to use when anchoring the furniture to a wall depends on the type of wall. The skilled person will e.g. know that a wood based wall requires other fixing means that e.g. a brick wall.

The chest of drawers 1 is preferably provided with one arrangement for tipping over prevention along each side wall 2.

The bar 300 has been disclosed as being arranged in the side wall 2. It is possible with remained function to alternatively arrange the bar 300 in the rear wall 3.

The invention claimed is:

1. An arrangement for tipping over prevention of a furniture, the arrangement comprising:

(a) a bar; and (b) an attachment adapted to anchor the furniture to a wall, wherein the attachment comprises:

(i) a guiding bracket having a guiding means, the guiding bracket being adapted to be fixedly mounted to a side wall of the furniture so that the guiding means extends parallel with the side wall of the furniture; and (ii) an anchoring bracket adapted to be movable between a first position and a second position relative to the guiding bracket while being guided by the guiding means, said anchoring bracket having an anchoring portion adapted to anchor the furniture to the wall by a fixing means when the anchoring bracket is arranged in the second position, and a wedge shaped support member; and wherein the bar is adapted to be mounted to the side wall or a rear wall of the furniture, and being movable between a restriction position and a clearance position, said bar having a projection being arranged to abut the wedge shaped support member of the anchoring bracket, and a stop member adapted to interact with a projection of a drawer of the furniture, whereby when the anchoring bracket is moved from the first position to the second position, the wedge shaped support member forces the projection to move along the wedge shaped support member thereby moving the bar from the restriction position to the clearance position, in which clearance position the drawer is allowed to be pushed or pulled past the stop member.

2. The arrangement according to claim 1, wherein the guiding bracket comprises a longitudinal groove adapted to movably receive a tongue of the anchoring bracket, whereby the movement of the anchoring bracket in view of the guiding bracket between the first and the second positions is restricted by the tongue abutting either of the two end portions of the longitudinal groove.

3. The arrangement according to claim 1, wherein the guiding means of the guiding bracket comprises first and second guiding flanges facing each other and adapted to encircle a respective longitudinal edge portion of the anchoring bracket.

4. The arrangement according to claim 1, wherein the anchoring bracket comprises a base plate and wherein the projection of the bar is arranged to abut a wall of the wedge shaped support member extending orthogonally to the base plate.

5. The arrangement according to claim 1, wherein the anchoring bracket comprises a base plate, and wherein the wedge shaped support member is arranged to extend along a first side of the base plate and wherein the anchoring portion is arranged to project in the orthogonal direction from a second side of the base plate.

6. The arrangement according to claim 1, wherein the guiding bracket comprises a base plate adapted to abut the side wall of the furniture, wherein said base plate as seen in its thickness direction comprises a recess adapted to receive at least a part of the wedge shaped support member of the anchoring bracket.

7. The arrangement according to claim 1, wherein the bar is constructed to be movably received in a groove arranged in the side wall of the furniture.

8. The arrangement according to claim 1, wherein the bar further comprises a grip member.

9. The arrangement according to claim 1, wherein the stop member of the bar comprises a sliding surface adapted to interact with the projection of the drawer to thereby temporarily set the bar to its clearance position as the drawer pushed past the stop member.

10. A furniture comprising an arrangement for tipping over prevention, wherein the arrangement comprises:

(a) a bar; and (b) an attachment adapted to anchor the furniture to a wall, wherein the attachment comprises:

(i) a guiding bracket having a guiding means, the guiding bracket being adapted to be fixedly mounted to a side wall of the furniture so that the guiding means extends parallel with the side wall of the furniture; and (ii) an anchoring bracket adapted to be movable between a first position and a second position relative to the guiding bracket while being guided by the guiding means, said anchoring bracket having an anchoring portion adapted to anchor the furniture to the wall by a fixing means when the anchoring bracket is arranged in the second position, and a wedge shaped support member; and wherein the bar is adapted to be mounted to the side wall or a rear wall of the furniture, and being movable between a restriction position and a clearance position, said bar having a projection being arranged to abut the wedge shaped support member of the anchoring bracket, and a stop member adapted to interact with a projection of a drawer of the furniture, whereby when the anchoring bracket is moved from the first position to the second position, the wedge shaped support member forces the projection to move along the wedge shaped support member thereby moving the bar from the restriction position to the clearance position, in which clearance position the drawer is allowed to be pushed or pulled past the stop member.

11. The furniture according to claim 10, further comprising a rear wall comprising an access opening allowing access to the grip member.

12. The furniture according to claim 10, wherein the furniture is a chest of drawers or a cabinet comprising at least one drawer, and wherein each drawer is supported by guiding rails arranged in the opposing side walls of the chest of drawers, wherein at least one of said guiding rails is arranged on top of and across the groove containing said bar.

* * * * *